United States Patent [19]

Yamada et al.

[11] Patent Number: 4,481,288

[45] Date of Patent: Nov. 6, 1984

[54] LIGHT-SENSITIVE SILVER HALIDE PHOTOGRAPHIC MATERIAL

[75] Inventors: Yoshitaka Yamada; Toshifumi Iijima; Toshihiko Yagi; Yoshihiro Haga; Kenji Kumashiro; Hiroshi Menjo, all of Hino, Japan

[73] Assignee: Konishiroku Photo Industry Co., Ltd., Tokyo, Japan

[21] Appl. No.: 542,372

[22] Filed: Oct. 14, 1983

[30] Foreign Application Priority Data

Oct. 19, 1982 [JP] Japan ..... 57-184174

[51] Int. Cl.[3] ..... G03C 1/46; G03C 1/02

[52] U.S. Cl. ..... 430/506; 430/502; 430/509; 430/567

[58] Field of Search ..... 430/506, 502, 509, 567

[56] References Cited

U.S. PATENT DOCUMENTS 4,184,876 1/1980 Eeles et al. ..... 430/506

4,370,410 1/1983 Iijima et al. ..... 430/506

4,438,194 3/1984 Hamada ..... 430/506

4,446,226 5/1984 Yamashita et al. ..... 430/506

*Primary Examiner*—Mary F. Downey

*Attorney, Agent, or Firm*—Frishauf, Holtz, Goodman & Woodward

[57] ABSTRACT

There is disclosed a light-sensitive silver halide photographic material having at least one silver halide emulsion layer constituted of a plural number of layers which are substantially the same in color to which they are sensitive but different in sensitivity provided on a support, which comprises a layer having the highest sensitivity among the plural number of layers with different sensitivities which contains at least two kinds of substantially mono-dispersed silver halide grains with different average grain sizes.

The light-sensitive silver halide photographic material according to this invention is high in sensitivity and excellent in graininess of dye image.

5 Claims, No Drawings

LIGHT-SENSITIVE SILVER HALIDE PHOTOGRAPHIC MATERIAL

This invention relates to a light-sensitive silver halide photographic material, more particularly to a light-sensitive silver halide photographic material having a high sensitivity and improved in image quality.

In the art of light-sensitive silver halide photographic materials for color, particularly light-sensitive silver halide photographic materials for photographing, they have been desired to be endowed with various requisite performances, such as high sensitivity with good image quality, and also with excellent color production as well as excellent latitude in light exposure. Thus, up to date, a large number of improved techniques concerning production of photosensitive materials for color have been developed, and performances of light-sensitive photographic materials are still under the progress of improvement at the present time. Hoever, generally speaking, in designing of light-sensitive silver halide photographic materials, sensitivity and image quality are antagonistic to each other. For example, when sensitivity is enhanced, there will frequently occur lowering in image quality. Accordingly, in recent years, it has been particularly desired to establish as early as possible the technique for obtaining a photosensitive material which is high in sensitivity and also excellent in image quality. And, as the technical means for improvement of image quality with maintenance of high sensitivity, the following improved methods have been known.

(1) The method in which sensitivity of silver halide emulsion of fine grains is enhanced.
(2) The method in which graininess is improved by mixing adequately silver halide grains with different grain sizes.
(3) The method in which color formed images are attempted to be micropulverized into fine grains by the use of DIR compound or DIR coupler.
(4) The method in which fine grain images are obtained by the use of a poor color forming efficiency.
(5) The method in which graininess of dye images is improved by utilization of a dye having good dispersibility.
(6) The method in which graininess of dye images is improved by reduction in an amount of the coupler employed relative to silver halide.

The above-mentioned techniques are each intended for improvement of graininess of images, but they involve the problems as mentioned below and are not necessarily satisfactory.

That is, for example, improvement of sensitivity can difficultly be accomplished according to the methods of item 1 and item 2 among the improvement techniques as set forth above. On the other hand, according to the methods of item 3 and item 4, the color density of the dye image obtained is lower, and it is required for improvement of this drawback to increase the amount of silver halide employed. This, however, is not desirable, because of incompatibility with the requirement of silver saving. Further, as to the techniques described above in item 5 and item 6, they belong to techniques whereby the so-called dye cloud, in which color forming dye is formed at a distance far from exposed silver halide grains, is expanded and therefore obscure images are obtained to deteriorate sharpness of the images.

As described above, various problems remain to be solved. On the other hand, in multi-layer color light-sensitive materials, there is also known a constitution in which a unit light-sensitive silver halide emulsion layer having light-sensitivity to the same spectral wavelength region is divided into plural layers, for example, 2 to 3 layers with different sensitivities, respectively, which are to be laminated in layers.

Such a light-sensitive material has the effect of improvement in graininess of dye image as well as in exposure latitude which are improved by far greater than those of the prior art, but still another requirement has been aroused in recent years. That is, in spite of progress of sensitivity and image quality by the improvement techniques as described above, miniatuarization of image face sizes of color negative light-sensitive materials for photographing have recently been desired, particularly with minaturization of cameras. Further, it has more strongly been desired to effect higher sensitization of the light-sensitive materials accompanied with necessity of higher shutter speed to cancel the shutter movement caused by the above miniaturization of the image face sizes. Thus, technical developments concerning high sensitization and improvement of image quality in color light-sensitive materials are becoming more intensely desired.

Accordingly, it is a first object of this invention to provide a light-snesitive silver halide color photographic material which is high in sensitivity and excellent in graininess of dye image.

The present inventors have made various investigations and found that the above object can be accomplished by a light-sensitive silver halide photographic material having at least one silver halide emulsion layer constituted of a plural number of layers which are substantially the same in color to which they are sensitive but different in ssnsitivity provided on a support, which comprises a layer having the highest sensitivity among the plural number of layers with different sensitivities which contains at least two kinds of substantially mono-dispersed silver halide grains with different average grain sizes, the averge grain size ($X_1$) of the mono-dispersed silver halide grains having the largest average grain size and the average grain size ($X_2$) of the mon-dispersed silver halide grain size having the second largest average grains among the mono-dispersed silver halide grains with different average grain sizes satisfying the correlation formula (I) shown below:

Correlation formula (I):

$$0.1 \leqq \log (X_1/X_2)^2 \leqq 0.6$$

According to this invention, in a multi-layer light-sensitive color photographic material, unit light-sensitive layer having sensitivity to substantially the same color is constituted of a plural number of layers with different sensitivites, and at least two kinds of mono-dispersed silver halide grains are incorporated in at least the layers with highest sensitivity among them, whereby there could be obtained a light-sensitive silver halide photographic material effectively improved in graininess without causing sensitivity reduction.

The present invention will be described in further detail below.

The light-sensitive silver halide photographic material of the present invention (hereinafter written merely as light-sensitive material of this invention) is a light-sensitive silver halide photographic material having at least one silver halide emulsion constituted of a plural number of layers which are sensitive to substantailly the same color but different in sensitivities.

The above layers which are sensitive to substantially the same color mean a light-sensitive silver halide emulsion layer having sensitivity to either of blue light, green light or red light in conventional photographic system. In this invention, such a light-sensitive emulsion layer is used as the unit layer, and further this is constituted by lamination of a plural number of layers divided into, for example, 2 to 3 layers with different sensitivities.

In this invention, at least one layer of the above unit layer having the same color-sensitivity is provided on a support, and there are also included multi-layer light-sensitive color photographic materials in general. And, in the case of the above multi-layer light-sensitive color photographic materials, the nuit layers are arranged generally in the order of the red-sensitive emulsion layer, the green-sensitive emulsion layer and the blue-sensitive emulsion layer from the support side, and although other arrangements may be possible, the former arrangement is preferred. There may also be provided various intermediate layers between the respective layers as mentioned above, if desired.

When the light-sensitive layer with the same color-sensitivity of each unit layer is constituted of a plural number of layers with different sensitivites, it is preferred to arrange the layer with the highest sensitivity among the aforesaid plural number of layers at the remotest position from the support side, sensitivity of the layers being successively lower toward the support.

In the light-sensitive material of this invention, the characteristic feature resides in incorporation of at least two kinds of substantially mono-dispersed silver halide grains with different average grain sizes in at least the light-sensitive layer with the highest sensitivity in the above unit layer consisting of a plural number of layers. Further, according to the light-sensitive material of this invention, it is also a preferred embodiment to contain at least two kinds of mono-dispersed silver halide grains in layers other than the layer with the highest sensitivity in the same color-sensitive layer constituted of a plural number of layer with different sensitivities as described above. The substantially mono-dispersed silver halide grains mentioned in this invention refer to those in which scattering of the silver halide grain sizes relative to the average grain size has a grain size distribution of a certain proportion or less as shown below. The grain size distribution of an emulsion comprising a group of grains which are regular in grain forms of the silver halide grains and small in scattering of grain sizes (hereinafter referred to as mono-dispersed emulsion) will form motly a Gaussian distribution and therefore its standard deviation can easily be determined. When the broadness of distribution is defined by the following formula:

$$\frac{\text{Standard deviation}}{\text{Average grain size}} \times 100 = \text{Broadness of distribution (\%)},$$

the broadness of distribution of the silver halide grains according to this invention is 20% or less, having preferably a mono-dispersibility of 15% or less.

In this invention, when the average grains size of the silver halide grains with the largest average grain size among at least two kinds of silver halide grains with different average grain sizes is represented conveniently by $X_1$ and the average grain size of the silver halide grains with the next largest average grain size by $X_2$, it is preferred to employ silver halide grains with the average grain size of $X_1$ preferably of 0.4μ to 2.0μ, and the average grains size of $X_2$ which is within the range represented by the above correlation formula (I).

As described above, the average grain sizes of the silver halide grains according to this invention are represented by the correlation formula (I). More preferably, however, the average grain sizes of $X_1$ and $X_2$ should fall within the range shown below:

$$0.15 \leqq \log (X_1/X_2)^2 \leqq 0.4$$

The mixing ratio of the above-mentioned two silver halide grains with different average grain sizes to be used in this invention may be 0.1 to 5.0, preferably 0.2 to 5.0, in terms of the weight ratio of the mono-dispersed silver halide grains having the average grain size of $X_1$ to the mono-dispersed silver halide grains having the average grain size of $X_2$.

In order to obtain the effect according to this invention, it is preferred to mix the mono-dispersed siler halide grains having the average grain sizes satisfying the above correlation formula (I) and employ them in the layer constitution as described above. If necessary, for example, other silver halide grains than the mono-dispersed silver halide grains according to this invention can also be incorporated to an extent which does not impair the effect of the invention.

Further, as the method for mixing the two silver halide grains with different grain sizes according to this invention, the grains obtained after completion of the first ripening step (physical ripening) may be mixed with each other. Preferably, however, the grains sensitized after completion of the second ripening (chemical ripening) should be mixed with each other. More specifically, they can be mixed immediately after completion of the second ripening, or alternatively the emulsions after completion of ripening may be set before mixing.

As the silver halide grains to be used in the layer with the highest sensitivity among the plural number of layers constituting each unit layer having the same color-sensitivity in the light-sensitive material of this invention, there may be employed, for example, silver bromide, silver iodide, silver iodobromide, silver chloroiodobromide and the like, and the crystal form of the silver halide grains may be any of crystals having hexahedral, octahedral, tetradecahedral or other crystal habbits, so long as they are mono-dispersed. Particularly, octahedral and tetradecahedral crystals are preferred. Further, the silver halide grains according to this invention may be homogeneous in silver halide composition or alternatively they may be silver halide grains of the core-shell type.

To describe next about the method for prepation of the silver halide emulsion according to this invention, the silver halide grains in the silver halide emulsion to be used in this invention may be obtained according to any of the acidic method, the neutral method and the ammoniacal method. Also, for example, it is possible to use a method in which seed grains are prepared according to the acidic method, which are then grown according to the ammoniacal method with higher growth rate to desired sizes. When silver halide grains are to be grown, it is desirable to control pH and pAg in the reactor and mix silver ions and halide ions by injecting successively or simultaneously in amounts corresponding to the growth rate of silver halide grains, as disclosed in Japanese Provisional Patent Publication No. 48521/1979.

For example, "Base of Photographic Engineering" (published by Corona Co., 1979), page 158, discloses general description about the above technique. More specifically, Belgian Pat. No. 636,801 discloses, as the method for providing mixed silver halide grains having a very narrow grain size distribution, the so-called lamination type emulsion, in which when adding residual reactants to the seed grains previously formed, in order to cause no increase or decrease in number of grains, a soluble silver salt and a soluble halide salt which are residual reactants are added in amounts corresponding to the growth rate of the grains and while maintaining the silver ion concentration in the emulsion at a constant level. Also, Japanese Patent Publication No. 42738/1980, and Japanese Provisional Patent Publications Nos. 158220/1979, 124139/1980, 142329/1980 and 30122/1981 disclose the method in which reactants are added to the seed grains having a narrow distribution similar to those as described above according to the simultaneous mixing method in amounts corredponding to the rate of growth of the grains while maintaining the silver ion concentration to obtain a desired emulsion.

The mono-dispersed silver halide emulsion grains according to this invention can be easily prepared according to the method as described above.

The excessive halide components formed during preparation of the emulsion according to this invention or salts or compounds such as nitrates, ammonia, etc. which are by-produced or became unnecessary may be eliminated. As the elimination method, there may be suitably employed the Noodel water washing method, the dialyzing method or the coagulating precipitation method conventionally employed in emulsions in general.

Further, the above silver halide emulsion may be sensitized with a sulfur sensitizer such as allyl thiocarbamide, thiourea, cystine, etc.; an active or inert selenium sensitizer; a reducing sensitizer such as stannous salt, a polyamine, etc.; a noble metal sensitizer, such as gold sensitizer, more specifically potassium aurithiocyanate, potassium chloroaurate, 2-aurosulfobenzthiazolemethyl chloride, etc., or a sensitizer of a water-soluble salt such as of ruthenium, rhodium, iridium and the like, more specifically, ammonium chloropalladate, potassium chloroplatinate and sodium chloropalladide, etc.; each being employed either singly or in a suitable combination.

Also, in the above silver halide emulsion, various known additives for photography may be contained. For example, there may be employed additives for photography as disclosed in Research Disclosure, Item 17643, December, 1978.

Further, this silver halide may be optically sensitized to a desired wavelength region. The method for optical sensitization of the present invention is not particularly limited. For example, optical sensitization may be possible by using an optical sensitizer, including a cyanine dye such as zeromethyne dye, monomethyne dye, dimethyne dye, trimethyne dye, etc. or a merocyanine dye, either singly or in combination (e.g. super color sensitization). These techniques are also disclosed in U.S. Pat. Nos. 2,912,329, 3,397,060, 3,615,635, and 3,628,964; U.K. Pat. Nos. 1,195,302, 1,242,588 and 1,293,862; German OLS Nos. 2,030,326 and 2,121,780; Japanese Patent Publications Nos. 4936/1968 and 14030/1969. Its choice may be determined as desired depending on the wavelength region to which it is to be sensitized, sensitivity etc. as well as on the purpose and use of the light-sensitive material.

The above emulsion may also contain various additives conventionally used depending on its purpose. These additives may include, for example, stabilizers or antifoggants such as azaindenes, triazoles, tetrazoles, imidazolium salts, tetrzolium slats, polyhydroxy compounds and others; film hardeners such as of aldehyde type, aziridine type, isoxazole type, vinyl sulfone type, acryloyl type, adipodiimide type, maleimide type, methansulfonic acid ester type, triazine type, etc.; developing promoters such as benzyle alcohol, polyoxyethylene type compounds, etc.; image stabilizers such as of curomane type, curamane type, bisphenol type, phosphite ester type, etc.; and lubricants such as wax, glycerides of higher fatty acids, higher alcohol esters of higher fatty acids, etc. Also, as coating aids, modifiers of permeability into processing liquors, defoaming agents or the materials for controlling various physical properties, there may be employed various kinds of surfactants such as of anionic type, cationic type, nonionic type or amphoteric type. As antistatic agents, there may be effectively employed diacetyl cellulose, styrene-perfluoroalkyl sodium maleate copolymer, an alkali salt of a reaction product between styrene-maleic anhydride copolymer and p-aminobenzenesulfonic acid. Illustrative of matting agents are polymethyl methacrylate, polystyrene and alkali-soluble polymers. Further, it is also possible to use colloidal silicon oxide. Also, as the latex to be added for improvement of the film properties, there may be employed copolymers of acrylic acid ester, vinyl ester, etc. with other monomers having ethylenic groups. Gelatin plasticizers may be exemplified by glycerine and glycol type compounds, and thickeners may include styrene-sodium maleate copolymer, alkyl vinyl ether-maleic acid copolymer and the like.

As the hydrophilic colloid to be used in the emulsion according to this invention, not only gelatin but also gelatin derivatives, polymer grafts of gelatin, synthetic hydrophilic macromolecular substances and natural hydrophilic macromolecular substances other than gelatin may also be available either as a single species or in a mixture.

As the support for the light-sensitive material by the use of the emulsion according to this invention as prepared above, there may be employed, for example, baryta paper, polyethylene-coated paper, polypropylene synthetic paper, glass paper, cellulocse acetate, cellulose nitrate, polyvinyl acetal, polypropylene, polyester film such as of polyethyleneterephthalate, polystyrene, etc. These supports may be chosen suitably depending on the purpose of use of the respective light-sensitive silver halide photographic material.

These supports may be applied with subbing treatment, if necessary.

For application of the emulsion according to this invention for the light-sensitive material for color, recourse may be made to the method and the materials employed for the light-sensitive material for color such as by incorporation of cyan, magenta and yellow couplers in combination to the emulsion of this invention controlled to red-sensitive, green-sensitive and blue-sensitive. As the yellow coupler, there may be employed the known closed-chain ketomethylene type couplers. Among them, benzoylacetanilide type and pivaloylacetanilide type compounds are useful.

As the magenta coupler, there may be employed pyrazolone type compounds, pyrazolotriazole compounds, indazolone type compounds, cyanoacetyl compounds. As the cyan coupler, phenol compounds, naphthol type compounds are useful.

The light-sensitive material prepared by the use of the emulsion of this invention may be subjected to light exposure and then developed according to the known method conventionally used.

The color developer which can be used in this invention may preferably contain an aromatic primary amine type color developing agent as the principal ingredient. Representative examples of this color developing agent are those of p-phenylenediamine type, including diethyl-p-phenylenediamine hydrochloride, monomethyl-p-phenylenediamine hydrochloride, dimethyl-p-phenylenediamine hydrochloride, 2-amino-5-diethylaminotoluene hydrochloride, 2-amino-5-(N-ethyl-N-dodecylamino)toluene, 2-amino-5-(N-ethyl-N-β-methanesulfonamidoethyl)aminotoluene sulfate, 4-(N-ethyl-N-β-methanesulfonamidoethylamino)aniline, 4-(N-ethyl-N-β-hydroxyethylamino)aniline, 2-amino-5-(N-ethyl-N-β-methoxyethyl)aminotoluene and the like.

After development, ordinary steps of bleaching for removal silver and silver halide, fixing or bleach-fixing, washing and drying are performed.

This invention is illustrated in detail by referring to the following Examples, by which the embodiments of this invention are not limited.

EXAMPLE 1

(1) Preparation of mono-dispersed emulsion

Into a reactor to which seed grains of silver halide and and aqueous gelatin solution had been previously charged were added an ammoniacal aqueous silver nitrate solution and an aqueous potassium bromide solution in proportion to the increase in the surface area during growth of grains, while controlling pAg and pH in the reactor. Then, an aqueous Demon N solution (produced by Kao Atlas Co.) and an aqueous magnesium sulfate solution were added to effect precipitating desalting, followed by addition of gelatin, to obtain an emulsion of pAg 7.8 and pH 6.0. Further, chemical ripening was conducted with addition of sodium thiosulfate, chloroauric acid and ammonium rhodanate, and 4-hydroxy-6-methyl-1,3,3*a*,7-tetrazaindene and 6-nitrobenzimidazole were added, followed further by addition of gelatin to obtain a mono-dispersed silver iodobromide emulsion. Here, the ratio of potassium iodide to potassium bromide was varied to vary the silver iodide molar % as indicated in Table 1. Also, by varying the amounts of ammoniacal silver nitrate and potassium halide added, the grain size was varied. Further, by varying the pAg during the reacion, crystal habits were varied to obtain the mono-dispersed emulsion samples B, C, D, E, G, I and J as shown in Table 1.

(2) Preparation of poly-dispersed emulsion

An aqueous silver nitrate solution and an aqueous alkali halide solution were permitted to drop naturally into a reactor maintained at 60° C. to which an aqueous gelatin solution and an excess of a halide had been charged, then an aqueous Demol N solution (produced by Kao Atlas Co.) and an aqueous magnesium sulfate solution were added to effect precipitation and desalting, followed by addition of gelatin, to obtain an emulsion of pAg 7.8 and pH 6.0. Further, chemical ripening was conducted with addition of sodium thiosulfate, chloroauric acid and ammonium rhodanate, and 4-hydroxy-6-methyl-1,3,3,*a*,7-tetrazaindene and 6-nitrobenzimidazole were added, followed further by addition of gelatin to obtain a poly-dispersed silver iodobromide emulsion. Here, the alkali halide composition was varied to vary the silver iodide molar % as indicated in Table 1. Also, by varying the time for addition of the aqueous silver nitrate solution and the aqueous alkali halide solution, average grains size and grains size distribution were varied, and the poly-dispersed emulsion samples A, F and H as shown in Table 1 were prepared.

TABLE 1

| Emulsion sample | Average grain size | Broadness of grain size distribution % | Silver iodide mole % |
|---|---|---|---|
| A | 0.80 | 31 | 6 |
| B | 0.80 | 9 | 6 |
| C | 0.81 | 8 | 7 |
| D | 0.66 | 8 | 6 |
| E | 0.66 | 10 | 7 |
| F | 0.59 | 35 | 6 |
| G | 0.58 | 8 | 6 |
| H | 0.38 | 32 | 6 |
| I | 0.37 | 8 | 6 |
| J | 0.23 | 9 | 6 |

EXAMPLE 2

On a transparent cellulose triacetate film applied with subbing treatment, the respective layers as shown below were provided successively by coating to prepare Sample 1 (in all of the Examples shown below, the amount added into the light-sensitive silver halide photographic material shows an amount per 1 $m^2$m, and the amount of silver halide emulsion and colloidal silver are shown in weight of silver).

Preparation of Sample 1

Layer 1: Halation preventive layer containing 0.4 g of black colloidal silver and 3 g of gelatin.

Layer 2: Layer containing 0.8 g of a low sensitivity green-sensitive silver iodobromide emulsion (an emulsion of the emulsion sample F as shown in the above Table 1 which has been sensitized to green-sensitive):

Low sensitivity green-sensitive emulsion containing 2.2 g of gelatin and 0.95 g of tricresyl phosphate having dissolved 0.8 g of 1-(2,4,6-trichlorophenyl)-3-[3-(2,4-di-t-amylphenoxyacetamido)benzamido]-5-pyrazolone [hereinafter called as magenta coupler (M-1)], 0.016 g of 4-octadecylsuccinimide-2-(1-phenyl-5-tetrazolylthio)-1-indanone DIR compound (hereinafter called as D-1) and 0.15 g of 1-(2,4,6-trichlorophenyl)-4-(1-naphtylazo)-3-(2-chloro-5-octadecenylsuccinimidoanilino)-5-pyrazolone [hereinafter called as colored magneta coupler (CM-1)] therein.

Layer 3: Layer containing 1.8 g of a high sensitivity green-sensitive silver iodobromide emulsion (an emulsion of the emulsion sample A as shown in the above Table 1 which has been sensitized to green-sensitive):

High sensitivity green-sensitive emulsion containing 1.9 g of gelatin and 0.25 g of tricresyl phosphate having dissolved 0.20 g of magenta coupler (M-1) and 0.049 g of colored magenta coupler (CM-1) therein.

Layer 4: Protective layer containing 2.3 g of gelatin.

Subsequently, according to the same procedure as described above in preparation of Sample 1, except for varying the combination of the emulsions used for the above layers 2 and 3 as shown in Table 2 below, 10 kinds of samples were prepared to provide Samples 1 to 10, respectively.

TABLE 2

| Sample No. | High sensitivity green-sensitive emulsion layer (Layer 3) | Low sensitivity green-sensitive emulsion layer (Layer 2) |
|---|---|---|
| 1 (Control) | Emulsion sample A (poly-dispersed) | Emulsion sample F (poly-dispersed)<br>Emulsion sample H (poly-dispersed) |
| 2 (Control) | Emulsion sample A (poly-dispersed) | Emulsion sample G (mono-dispersed)<br>Emulsion sample I (mono-dispersed) |
| 3 (Control) | Elmulsion sample B (mono-dispersed) | Emulsion sample F (poly-dispersed)<br>Emulsion sample H (poly-dispersed) |
| 4 (Control) | Emulsion sample B (mono-dispersed) | Emulsion sample G (mono-dispersed)<br>Emulsion sample I (mono-dispersed) |
| 5 (Control) | Emulsion sample C (mono-dispersed) | Emulsion sample G (mono-dispersed)<br>Emulsion sample I (mono-dispersed) |
| 6 (Control) | Emulsion sample B (mono-dispersed)<br>Emulsion sample I (mono-dispersed) | Emulsion sample G (mono-dispersed)<br>Emulsion sample I (mono-dispersed) |
| 7 (This invention) | Emulsion sample B (mono-dispersed)<br>Emulsion sample D (mono-dispersed) | Emulsion sample F (poly-dispersed)<br>Emulsion sample H (poly-dispersed) |
| 8 (This invention | Emulsion sample B (mono-dispersed)<br>Emulsion sample D (mono-dispersed) | Emulsion sample I (mono-dispersed)<br>Emulsion sample G (mono-dispersed) |
| 9 (This invention | Emulsion sample C (mono-dispersed)<br>Emulsion sample E (mono-dispersed) | Emulsion sample G (mono-dispersed)<br>Emulsion sample I (mono-dispersed)<br>Emulsion sample J (mono-dispersed) |
| 10 (This invention | Emulsion sample C (mono-dispersed)<br>Emulsion sample E (mono-dispersed) | Emulsion sample I (mono-dispersed)<br>Emulsion sample G (mono-dispersed) |

In the above Table, Samples Nos. 6 to 10 contain two kinds of mono-dispersed silver halide grains with different grain sizes at a proportion of 2:1 (greater grain:smaller grain) mixed in the high sensitivity emulsion layer, respectively. On the other hand, the mixing ratios of greater grain:smaller grain in the low sensitivity emulsion layer were made 1:1 in Samples 1–8 and 10, while the mixing ratio of greater grain:medium grain:smaller grain was made 1:0.5:0.5 in Sample 9 [the relations of average grains sizes between two kinds of silver halide grains used as mixtures in samples according to this invention were $\log (0.80/0.66)^2=0.17$ for emulsions B and D, $\log (0.81/0.66)^2=0.18$ for emulsions C and E and $\log (0.80/0.37)^2=0.67$ for emulsions B and I].

These ten kinds of samples were exposed to green light through a wedge in a conventional manner and then the following processings were performed.

| Processing step (33° C.) | Processing time |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |

-continued

| Processing step (33° C.) | Processing time |
|---|---|
| Stabilizing | 1 min. 30 sec. |

The processing liquors employed in the respective steps had the compositions as shown below.

Composition of Color Developer

4-Amino-3-methyl-N-ethyl-N-(β-hydroxyethyl)aniline sulfate: 4.75 g
Anhydrous sodium sulfite: 4.25 g
Hydroxyamine.½ sulfate: 2.0 g
Anhydrous potassium carbonate: 37.5 g
Sodium bromide: 1.3 g
Trisodium nitriloacetate (monohydrate): 2.5 g
Potassium hydroxide: 1.0 g
Water: (make up to) one liter Composition of Bleaching Liquor Ammonium ferric ethylenediaminetetraacetate: 100 g
Diammonium ethylenediaminetetraacetate: 10 g
Ammonium bromide: 150 g
Glacial acetic acid: 10 ml
Water: (make up to) one liter
(adjusted to pH 6.0 with ammonia water)

Composition of Fixing Liquor

Ammonium thiosulfate: 175.0 g
Anhydrous sodium sulfite: 8.6 g
Sodium metasulfite: 2.3 g
Water: (make up to) one liter
(adjusted to pH 6.0 with acetic acid)

Composition of Stabilizing Liquor

Formalin (37% aqueous solution): 1.5 ml
Konidax (produced by Konishiroku Photo Industry Co.): 7.5 ml
Water: (make up to) one liter For the color images obtained according to the above processing, relative sensitivity and graininess were measured for each sample by use of green light. The results of measurement are listed in Table 3 below. The relative sensitivity is shown in terms of the relative value of the reciprocal of the dosage giving a density of fog+0.1, and the above graininess is determined as the 1000-fold value of the standard deviation of fluctuations in density values when RMS at portions with the density of fog+0.3 and the density of fog+1.0 were scanned with an aperture of 25μ by means of Sakura Densitometer, Model PDM-5, Type AR (produced by Konishiroku Photo Industry Co.)

TABLE 3

| Sample No. | Relative sensitivity | RMS value Fog + 0.3 | RMS value Fog + 1.0 |
|---|---|---|---|
| 1 | 100 | 40 | 34 |
| 2 | 101 | 38 | 29 |
| 3 | 118 | 33 | 31 |
| 4 | 117 | 32 | 28 |
| 5 | 115 | 33 | 29 |
| 6 | 116 | 33 | 28 |
| 7 | 117 | 27 | 30 |
| 8 | 118 | 27 | 26 |
| 9 | 117 | 27 | 26 |
| 10 | 116 | 26 | 27 |

As apparently seen from the above Table, every one of the samples according to this invention (No. 7–10)

was found to be improved in graininess without accompaniment of sensitivity reduction. In particular, the effect of improvement in graininess is marked at the density of fog+0.3, and among the samples of this invention, the effect according to this invention was found to be further promoted in Samples 8, 9 and 10, in which mono-dispersed silver halide grains were employed also in the low sensitivity light-sensitive layer.

EXAMPLE 3

On a transparent cellulose triacetate film applied with subbing treatment, the respective layers shown below were successively provided by coating to prepare Sample 11.

Layer 1: The same as Layer 1 in Example 2

Layer 2: A layer containing 1.4 g of low sensitivity red-sensitive silver iodobromide emulsion (the emulsion sample H as shown in the above Table 1 which has been sensitized to red-sensitive):

Low sensitivity red-sensitive emulsion layer containing 1.2 g of gelatin and 0.65 g of tricresyl phosphate having dissolved 0.8 g of 1-hydroxy-2-[δ-(2,4-di-t-amylphenoxy)-n-butyl]naphthoamide [hereinafter called as cyan coupler (C-1)], 0.065 g of 1-hydroxy-4-[4-(1-hydroxy-δ-acetamide-3,6-disulfo-2-naphthylazo)-phenoxy]-N-[δ-(2,4-di-t-amylphenoxy)butyl-2-naphthoamide.disodium [hereinafter called as colored cyan coupler (CC-1)]and 0.015 g of the DIR compound (D-1) therein.

Layer 3: A layer containing 0.9 g of medium sensitivity red-sensitive silver iodobromide emulsion (the emulsion sample F as shown in the above Table 1 which has been sensitized to red-sensitive):

Medium sensitivity red-sensitive emulsion layer containing 0.9 g of gelatin and 0.25 g of tricresyl phosphate having dissolved 0.24 g of the cyan coupler (C-1) and 0.015 g of the colored cyan coupler (CC-1) therein.

Layer 4: A layer containing 1.3 g of high sensitivity red-sensitive silver iodobromide emulsion (the emulsion sample A as shown in the above Table 1 which has been sensitized to red-sensitive):

High sensitivity red-sensitive emulsion layer containing 1.2 g of gelatin and 0.23 g of tricresyl phosphate having dissolved 0.21 g of the cyan coupler (C-1) and 0.02 g of the colored cyan coupler (CC-1) therein.

Layer 5: Protective layer containing 2.3 g of gelatin.

In entirely the same manner as in preparation of the above Sample 11, except for varying the emulsions contained in the above layers 2, 3 and 4 to the emulsion samples as shown in Table 4, further Samples 12 to 16 were prepared. In the following Table 4, the mixing ratio of the two mono-dispersed emulsion grains in Samples 15 and 16 was 1:1.

TABLE 4

| Sample No. | High sensitivity red-sensitive emulsion layer (Layer 4) | Medium sensitivity red-sensitive emulsion layer (Layer 3) | Low sensitivity red-sensitive emulsion layer (Layer 2) |
|---|---|---|---|
| 11 (Control) | Emulsion sample A | Emulsion sample F | Emulsion sample H |
| 12 (Control) | Emulsion sample A | Emulsion sample G | Emulsion sample I |
| 13 (Control) | Emulsion sample B | Emulsion sample F | Emulsion sample H |
| 14 (Control) | Emulsion sample B | Emulsion sample G | Emulsion sample I |
| 15 (This invention) | Emulsion samples B & D | Emulsion sample F | Emulsion sample H |
| 16 (This invention) | Emulsion samples B & D | Emulsion sample G | Emulsion sample I |

Red light exposure was applied through a wedge on each of the six kinds of samples obtained, followed by processings similarly as described in Example 2 to obtain dye images. The relative sensitivity and graininess were measured according to the same methods as in Example 2 to obtain the results as listed in Table 5 below.

TABLE 5

| Sample No. | Relative sensitivity | RMS value Fog + 0.3 | RMS value Fog + 1.0 |
|---|---|---|---|
| 11 | 100 | 41 | 36 |
| 12 | 100 | 40 | 30 |
| 13 | 118 | 32 | 34 |
| 14 | 116 | 31 | 29 |
| 15 | 115 | 26 | 27 |
| 16 | 115 | 25 | 25 |

As apparently seen from the above Table, every one of the samples according to this invention (No. 15 and 16) is high in sensitivity and has the effect of improving graininess. This effect is particularly marked at the density of fog+0.3, and it can be also understood that the graininess at the leg portion becomes particularly good. It is also shown that the sample (16) of this invention is also effective in improvement of graininess particularly at high density.

EXAMPLE 4

On a transparent cellulose triacetate film applied with subbing treatment, the following respective layers were successively provided by coating to prepare Sample 17.

Layer 1: The Layer 1 as described in Example 3.

Layer 2: The Layer 2 as described in Example 3.

Layer 3: The Layer 3 as described in Example 3.

Layer 4: The Layer 4 as described in Example 3.

Layer 5: Intermediate layer containing 0.04 g of di-n-butyl phthalate (hereinafter called as DBP) having 0.07 g of 2,5-di-t-octylhydroquinone [hereinafter called as contamination preventive (HQ-1)] therein and 0.8 g of gelatin.

Layer 6: The Layer 2 as described in Example 2.

Layer 7: The Layer 3 as described in Example 2.

Layer 8: Yellow filter layer containing 0.15 g of yellow colloidal silver, 0.11 g of DBP having dissolved 0.2 g of the contamination preventive (HQ-1) therein and 1.5 g of gelatin.

Layer 9: Layer containing 0.50 g of low sensitivity blue-sensitive silver iodobromide emulsion (the emulsion H as shown in the above Table 1):

Low sensitivity emulsion layer containing 1.9 g of gelatin and 0.6 g of DBP having dissolved 1.5 g of α-pivaloyl-α-(1-benzyl-2-phenyl-3,5-dioxyoimidazolidine-4-yl)-2'-chloro-5'-[α-(dodecyloxycarbonyl)ethoxycarbonyl]acetanilide [hereinafter called as yellow coupler (Y-1)] therein.

Layer 10: Layer containing 1.0 g of high sensitivity blue-sensitive emulsion layer (the emulsion A as shown in the above Table 1):

High sensitivity blue-sensitive emulsion layer containing 1.5 g of gelatin and 0.65 g of tricreshyl phosphate having dissolved 1.30 g of the yellow coupler (Y-1) therein.

Layer 11: Protective layer containing 2.3 g of gelatin.

According to the same procedure as in preparation of the above Sample 17, except for varying the emulsions contained in the above layers 2, 3, 4, 6, 7 and 9 to those as shown in the Table 6 below, Sample 18 was prepared.

TABLE 6

| | Blue-sensitive layer | | Green-sensitive layer | | Red-sensitive layer | | |
|---|---|---|---|---|---|---|---|
| Sample No. | Layer 10 | Layer 9 | Layer 7 | Layer 6 | Layer 4 | Layer 3 | Layer 2 |
| 17 | Emulsion sample A | Emulsion sample F | Emulsion sample A | Emulsion sample F Emulsion sample H | Emulsion sample A | Emulsion sample F | Emulsion sample H |
| 18 | Emulsion sample B Emulsion sample D | Emulsion sample G | Emulsion sample B Emulsion sample D | Emulsion sample G | Emulsion sample B Emulsion sample D | Emulsion sample G | Emulsion sample I |

In the above Table, the mixing ratio of the silver halide grains in the layer in which two kinds of silver halide grains with different grains sizes are employed was 2:1 (greater grain:smaller grain) in the case of the layers 7 and 10 in Sample 18, and 1:1 (greater grain:smaller grain) in the cases of the layer 4 in Sample 18 and the layer 6 in Sample 17.

White light exposure was applied on each of Samples 17 and 18 through a wedge, followed by processings as described in Example 2, to obtain dye images. Then, for each of the above samples, the relative sensitivity and graininess were measured to obtain the results as shown in Table 7.

TABLE 7

| | Sample 17 | | | Sample 18 | | |
|---|---|---|---|---|---|---|
| | Relative sensitivity | RMS value | | Relative sensitivity | RMS value | |
| | | Fog + 0.3 | Fog + 1.0 | | Fog. + 0.3 | Fog + 1.0 |
| Blue-sensitive layer | 100 | 54 | 60 | 115 | 36 | 38 |
| Green-sensitive layer | 100 | 39 | 37 | 117 | 27 | 25 |
| Red-sensitive layer | 100 | 41 | 36 | 116 | 24 | 24 |

As can also be appreciated from the above Table, it has also been made clear that, by the use of two kinds of mono-dispersed silver halide grains with different grain sized in the high sensitivity emulsion layer and further by incorporating one kind of mono-dispersed silver halide grains in the light-sensitive layer with lower sensitivity than said emulsion layer, as in Sample 18, improvements of graininess and sensitivity in a multi-layer system light-sensitive material can be obtained in each one of blue-sensitive, green-sensitive and red-sensitive layers.

We claim:

1. A light-sensitive silver halide photographic material having at least one silver halide emulsion layer constituted of a plural number of layers which are substantially the same in color to which they are sensitive but different in sensitivity provided on a support, which comprises a layer having the highest sensitivity among the plural number of layers with different sensitivities which contains at least two kinds of substantially mono-dispersed silver halide grains with different average grain sizes, the average grain size ($X_1$) of the mono-dispersed silver halide grains having the largest average grain size and the average grain size ($X_2$) of the mono-dispersed silver halide grains having the second largest average grain size among the mono-dispersed silver halide grains with different average grain sizes satisfying the correlation formula (I) shown below:

Correlation formula (I):

$$0.1 \leqq \log (X_1/X_2)^2 \leqq 0.6.$$

2. A light-sensitive silver halide photographic material according to claim 1, wherein a broadness of distribution of the silver halide grains being 20% or less when the broadness of distribution is defined by the following formula:

$$\text{Broadness of distribution (\%)} = \frac{\text{Standard deviation}}{\text{Average grain size}} \times 100.$$

3. A light-sensitive silver halide photographic material according to claim 2, wherein a broadness of distribution of the silver halide grains being 15% or less.

4. A light-sensitive silver halide photographic material according to claim 1, wherein said average grain size of $X_1$ being 0.4μ to 2.0μ, and said average grain size of $X_2$ is within the range represented by the correlation formula (I).

5. A light-sensitive silver halide photographic material according to claim 1, wherein said average grain sizes of $X_1$ and $X_2$ being the range of $$0.15 \leqq \log (X_1/X_2)^2 \leqq 0.4.$$

* * * * *